US005944944A

United States Patent [19]

Gwo-Jiang

[11] Patent Number: 5,944,944

[45] Date of Patent: Aug. 31, 1999

[54] STRUCTURAL IMPROVEMENT OF BANDING GUN

[76] Inventor: Liaw Gwo-Jiang, No. 44, Chung Shan Rd., Hsinchuang, Taipei Hsien, Taiwan

[21] Appl. No.: 08/944,964

[22] Filed: Oct. 7, 1997

[51] Int. Cl.[6] ..... B65B 13/18

[52] U.S. Cl. ..... 156/510; 156/579; 100/33 PB

[58] Field of Search ..... 156/510, 579, 156/580; 100/29, 32, 33 R, 33 PB

[56] References Cited

U.S. PATENT DOCUMENTS

| | | | |
|---|---|---|---|
| 4,305,774 | 12/1981 | Wedeking et al. | 156/494 |
| 4,934,261 | 6/1990 | Niedrig | 100/32 |
| 5,116,453 | 5/1992 | Niedrig | 156/580 |
| 5,351,611 | 10/1994 | Schafer et al. | 100/30 |
| 5,471,920 | 12/1995 | Schafer et al. | 100/30 |
| 5,632,851 | 5/1997 | Young | 156/494 |
| 5,689,943 | 11/1997 | Wehr | 53/592 |

*Primary Examiner*—James Sells
*Attorney, Agent, or Firm*—Rosenberg, Klein & Bilker

[57] ABSTRACT

A type of structural improvement for banding gun, comprising a first handgrip and a second handgrip, the two handgrips are hinged on a hinge pin, between the two handgrips is a first connecting lever, one end of said first connecting lever is connected with the hinge pin, while the other end is connected to the front end of the tension-adjustable spring, the middle part of the first connecting lever is connected to the rear end of a second lever, the front end of the second connecting lever is connected to a band cutting blade, said band cutting blade is slid and accommodated in the front end of the first handgrip, serving to cut the fastening band automatically; so structured to achieve the functions of convenient operation, easy adjustment, etc.

3 Claims, 5 Drawing Sheets

STRUCTURAL IMPROVEMENT OF BANDING GUN

BACKGROUND OF THE INVENTION

The subject invention relates to a type of structural improvement of banding gun, particularly to one with convenient operation and easy adjustment.

Please refer to FIG. 1 which is a plain sectional view of a prior art of banding gun, said banding gun comprises two handgrips 10*a*, 11*a*, said two handgrips 10*a*, 11*a* are hinged as one unit on a hinge pin 12*a*, between the two handgrips 10*a*, 11*a* is a tension spring 13*a* that serves to pull the front ends of the two handgrips 10*a*, 11*a* to close together, at the front ends of the two handgrips 10*a*, 11*a* are through holes 14*a*, 15*a* to be pulled through by the fastening band, when the rear ends of the two handgrips are gradually pressed together, the front ends of the two handgrips 10*a*, 11*a* open gradually, while the catch piece 16*a* at the front of a handgrip 10*a* will catch and fasten one end of the band, so the front end of said handgrip 10*a* will pull tight the band, so the band will fasten the object tightly, when the object is fastened tight, a band-cutting handle 17*a* can be depressed to drive a band cutting blade 18*a* to move forward, to cut the excessive portion of the band after the fastening operation is accomplished. However, in such a prior art of banding gun mechanism, the band cutting blade 18*a* relies on the resetting tension provided by a tension spring 19*a*, said tension spring 19*a* could not adjust the tension properly, resulting in inconvenient operation in cutting the band, it has the weaknesses of inconvenient operation and inability of adjustment.

SUMMARY OF THE INVENTION

The primary objective of the subject invention is to present a type of structural improvement of banding gun, comprising a first handgrip and a second handgrip, the two handgrips are hinged on a hinge pin, between the two handgrips is a first connecting lever, one end of said first connecting lever is connected to the hinge pin, while the other end is connected to the front end of a tension-adjustable spring, the middle part of the first connecting lever is connected to the rear end of a second connecting lever, the front end of the second connecting lever is connected to a band cutting blade, said band cutting blade is slid and accommodated in the front end of the first handgrip, the subject invention uses the first connecting lever and the second connecting lever to drive the band cutting blade, when adjusting the spring tension, the pulling force of the spring is transmitted via the first connecting lever and the second connecting lever to the band cutting blade, instead of direct pulling on the band cutting blade by the spring, so it enables easier adjustment and better adjustment, and it has the functions of convenient operation and easy adjustment, etc.

To enable your better understanding of the characteristics and technical contents of the subject invention, please refer to the following detailed description with drawings; however, the attached drawings are only for the purposes of reference and description, which shall not be based to restrict or limit the subject invention:

Brief Description of Numerals

| | |
|---|---|
| 10 | first handgrip |
| 11 | second handgrip |
| 12 | hinge pin |
| 13 | slide way |
| 14 | first connecting lever |
| 15 | first connecting pin |
| 16 | spring |
| 17 | fixing seat |
| 18 | screw hole seat |
| 19 | adjusting bolt |
| 20 | threading part |
| 21 | spring |
| 22 | second connecting pin |
| 23 | second connecting lever |
| 24 | third connecting pin |
| 25 | band cutting blade |
| 26 | base plate |
| 27 | screw |
| 28 | nut |
| 29 | guide channel |
| 30 | through hole |
| 31 | through hole |
| 32 | catch piece |
| 33 | spring |
| 34 | band |
| 10a | handgrip |
| 11a | handgrip |
| 12a | hinge pin |
| 13a | tension spring |
| 14a | through hole |
| 15a | through hole |
| 16a | catch piece |
| 17a | band cutting handle |
| 18a | band cutting blade |
| 19a | tension spring |

DETAILED DESCRIPTION OF PREFERRED EMBODIMENT

Figure 1:
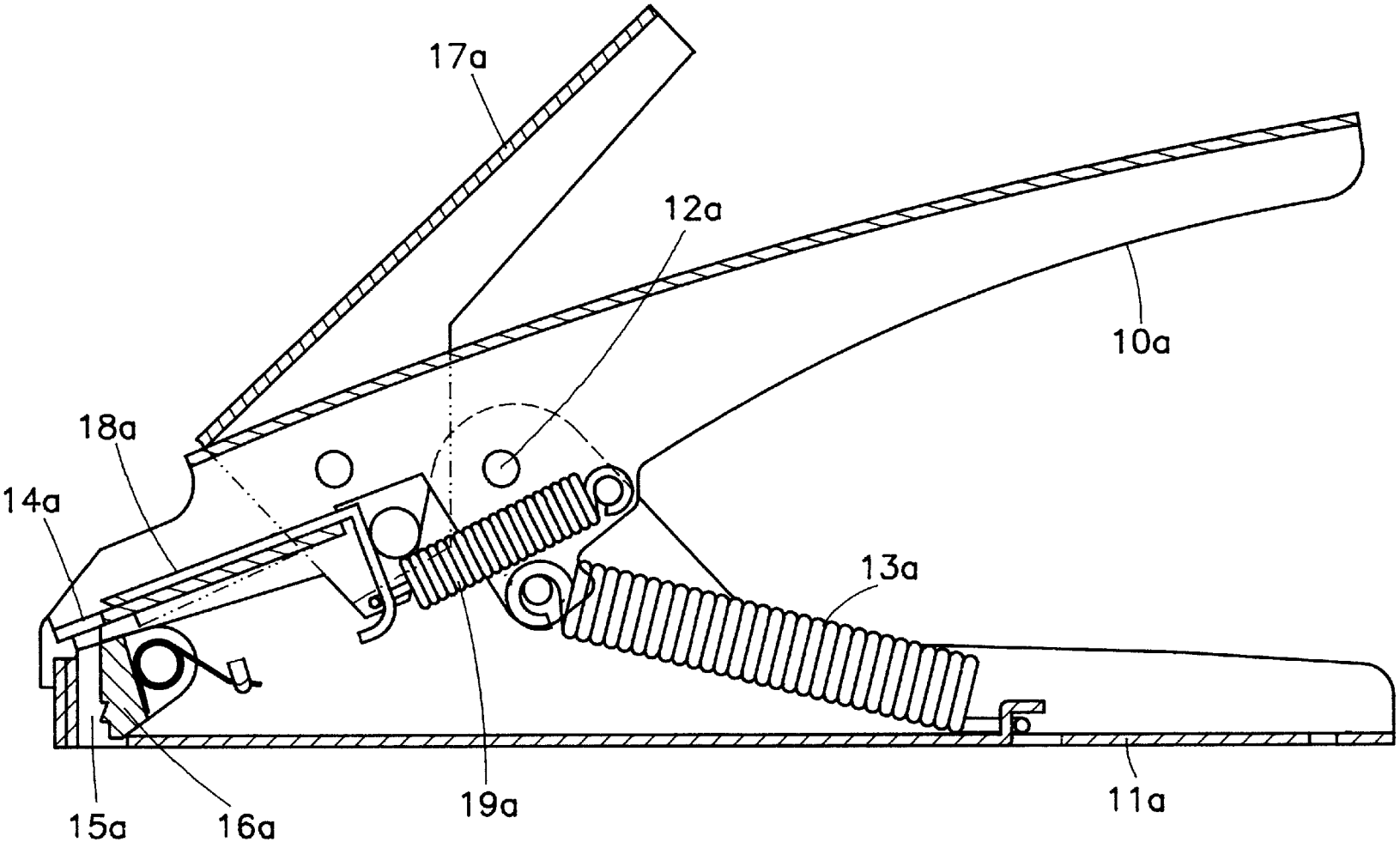
FIG. 1 is a plain sectional view of a prior art of banding gun.
Figure 2:
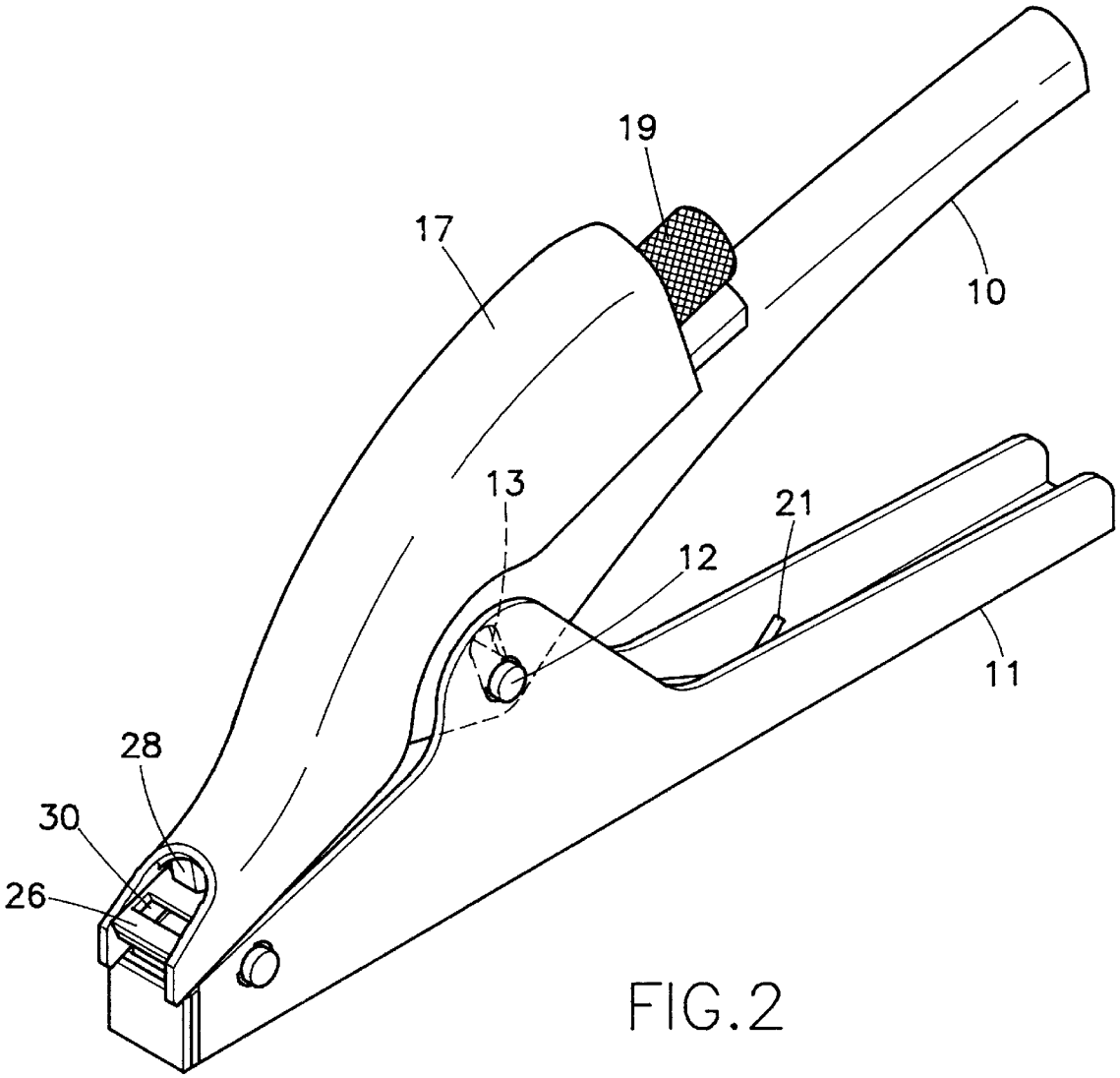
FIG. 2 is a perspective view of the subject invention.
Figure 3:
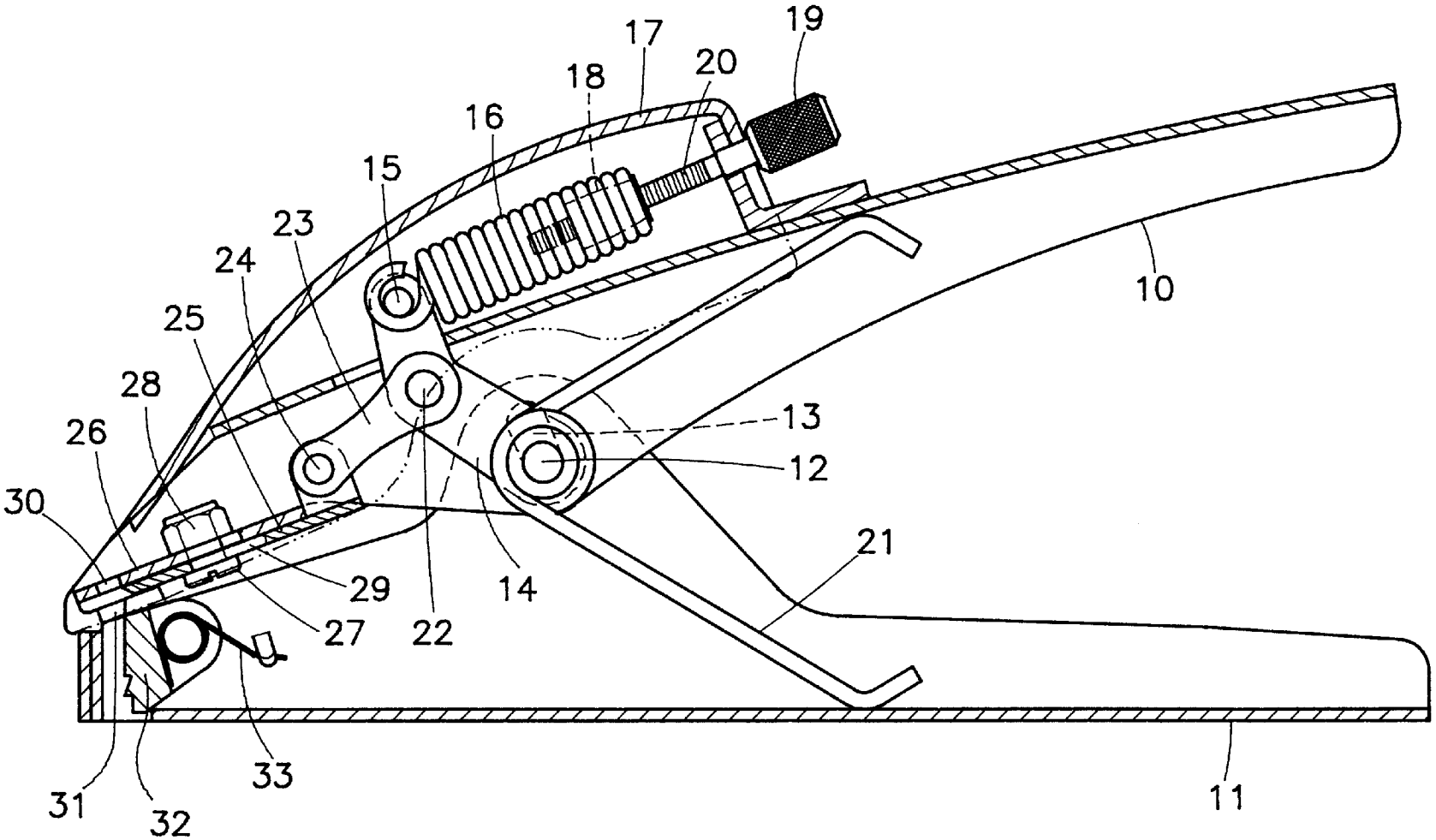
FIG. 3 is a plain sectional view of the subject invention.

Please refer to FIGS. 2 and 3 which are respectively a perspective view and a plain sectional view of the subject invention. The subject invention relates to the presentation of a type of structural improvement of banding gun, said banding gun comprises a first handgrip 10 and a second handgrip 11, said two handgrips 10, 11 are hinged on a hinge pin 12, both ends of said hinge pin 12 are accommodated in the slide way 13 at two sides of the first handgrip 10. Between the two handgrips 10, 11 is an elbow-shaped first connecting lever 14, one end of said first connecting lever 14 is joined as one unit with the hinge pin 12, another end of the first connecting lever 14 is connected by a first connecting pin 15 to a spring (tension spring) 16, fixed on the outside of the first handgrip 10 is a fixing seat 17,said spring 16 is located inside the fixing seat 17, the front end of the spring 16 is hooked to the first connecting pin 15, fixed on the rear end of the spring 16 is a screw hole seat 18, an adjusting bolt 19 is hinged to the rear end of the fixing seat 17, its threading part 20 is threaded to the screw hole seat 18 at the rear end of the spring 16, so the tension of the spring 16 may be adjusted by turning the adjusting bolt 19, and between the two handgrips 10, 11 is a spring (tension spring) 21 which serves to push the front ends of the two handgrips 10, 11 to close together. The middle part of the first connecting lever 14 is linked by a second connecting pin 22 to the rear end of a second connecting lever 23, the front end of the second connecting lever 23 is linked by a third connecting pin 24 to a band cutting blade 25, the front end of said band cutting blade 25 is a sharp blade, the band cutting blade 25 is slid and accommodated in the bottom of the base plate 26 at the front of the first handgrip 10, and is fixed in place by a screw 27 and a nut 28, the band cutting blade 25 is positioned between the screw 27 and the base plate 26, on the band cutting blade 25 is an elongated guide channel 29 to allow the screw 27 to pass through, so the band cutting blade 25 may move freely to and fro. At the front ends of the two handgrips 10, 11 are two through holes 30, 31 to allow the fastening band to pull through, at the rear side of the through hole 31 on the second handgrip 11 is a catch piece 32, said catch piece 32 may be pushed forward by a spring (tension spring) 33 to catch in place.

Figure 4:
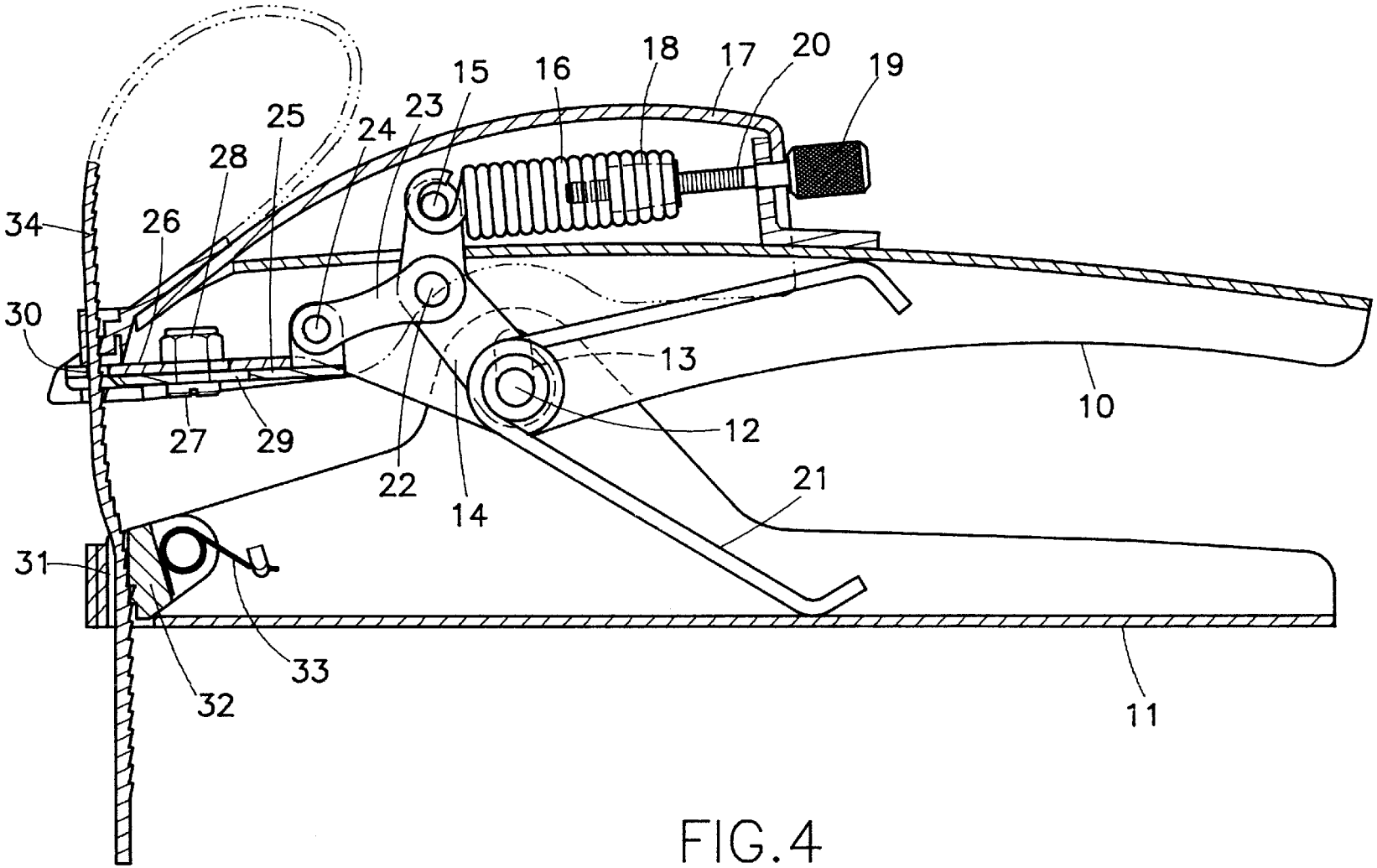
FIG. 4 is a view of the subject invention in operation.
Figure 5:
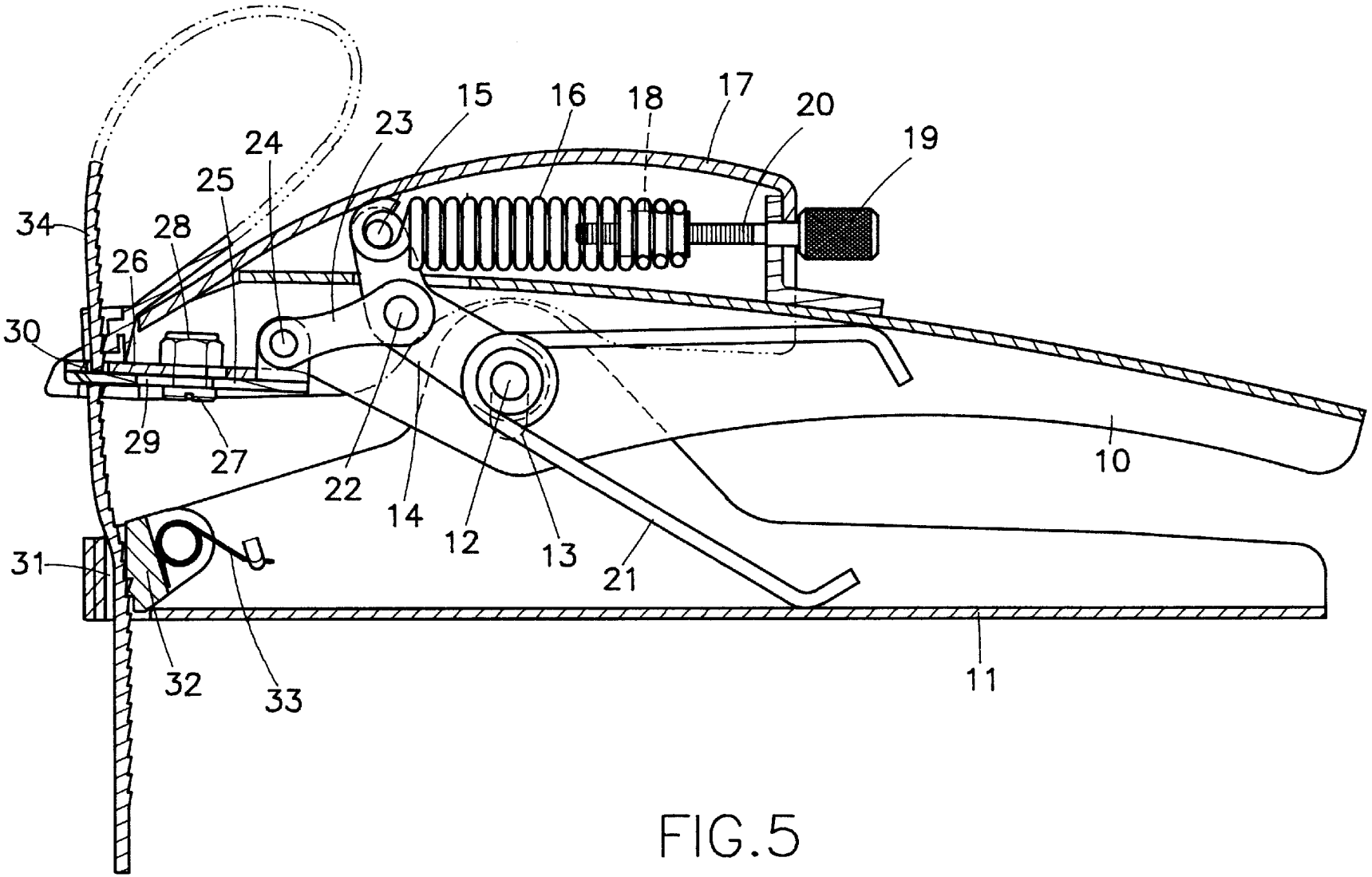
FIG. 5 is a view of the subject invention in operation.

Please refer to FIGS. 4 and 5 which are the views of the subject invention in operation, the band 34 may be pulled through the through holes 30, 31 at the front ends of the two handgrips 10, 11, so that when the rear ends of the two handgrips 10, 11 are gradually pressed together, the front ends of the two handgrips 10, 11 will gradually open, and the catch piece 32 at the front of the second handgrip 11 catches and fastens one end of the band 34, so the front of the second handgrip 11 will pull tight the band 34 (as illustrated in FIG. 4), so the band 34 will tightly fasten the object to be fastened, when the band 34 has tightened to some extent, the front ends of the two handgrips 10, 11 cannot be opened further wider, then, if the two handgrips 10, 11 are pressed further, the hinge pin 12 will move upward inside the slide way 13 of the first handgrip 10, which will cause the first connecting lever 14 to push the second connecting lever 23 to move forward, to drive the band cutting blade 25 at the front end of the second connecting lever 23 to move forward, to cut the excessive portion of the fastening band 34 that has completed the fastening operation, to achieve the function of automatic cutting on the band 34, without the need for an additional operation to cut the band 34, the operation is quite convenient, and the main feature of the subject invention is to drive the band cutting blade 25 with the devices of the first connecting lever 14 and the second connecting lever 23, when the adjusting bolt 19 is turned to adjust the tension of the spring 16, the pulling force of the spring 16 is transmitted through the first connecting lever 14 and the second connecting lever 23 to the band cutting blade 25, instead of direct pulling of the band cutting blade 25 by the spring 16, therefore, the turning of the adjusting screw for adjustment purpose is made easier to enable a better adjustment, convenient operation, easy adjustment and such functions.

Summing up, the subject invention, with such features of convenient operation and easy adjustment, is an unprecedented new version that will fully satisfy the qualifications for a patent right, hence this application is filed in accordance with the Patent Law to protect the subject inventor's rights and interests. Your favorable consideration shall be appreciated.

It is declared hereby that the above description, covering only the preferred embodiment of the subject invention, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. A type of structural improvement of banding gun, comprising a first handgrip and a second handgrip, said two handgrips being hinged as one unit on a hinge pin, both ends of said hinge pin being slid and accommodated inside the slide way at two sides of the first handgrip, between the two handgrips is a first connecting lever, one end of said first connecting lever being connected to the hinge pin, while the other end being connected to a tension-adjustable spring, between the two handgrips being a spring that serves to push together the front ends of the two handgrips, the middle part of the first connecting lever being connected to the rear end of the second connecting lever, the front end of the second connecting lever being connected to a band cutting blade, said band cutting blade being slid and accommodated in the front end of the first handgrip, at the front ends of the two handgrips being through holes, at the backside of the second handgrip being a catch piece, said catch piece being pushed in position by a spring.

2. The structural improvement of banding gun, as recited in claim 1, wherein the first connecting lever is elbow-shaped.

3. The structural improvement of banding gun, as recited in claim 1, wherein on the outside of the first handgrip is a fixing seat, said tension-adjustable spring is fixed in the fixing seat, at the rear end of the spring is a screw hole seat, an adjusting bolt is hinged in the fixing seat, the adjusting bolt is screwed to said screw hole seat, so the tension of the spring may be adjusted by turning the bolt.

* * * * *